US007556337B2

(12) United States Patent
Snyder

(10) Patent No.: US 7,556,337 B2
(45) Date of Patent: Jul. 7, 2009

(54) SYSTEM AND METHOD FOR EVALUATING LINE FORMATION IN AN INK JET IMAGING DEVICE TO NORMALIZE PRINT HEAD DRIVING VOLTAGES

(75) Inventor: Trevor James Snyder, Newberg, OR (US)

(73) Assignee: Xerox Corporation, Norwalk, CT (US)

( * ) Notice: Subject to any disclaimer, the term of this patent is extended or adjusted under 35 U.S.C. 154(b) by 272 days.

(21) Appl. No.: 11/591,839

(22) Filed: Nov. 2, 2006

(65) Prior Publication Data

US 2008/0122886 A1 May 29, 2008

(51) Int. Cl.
*B41J 29/393* (2006.01)

(52) U.S. Cl. ..... 347/19

(58) Field of Classification Search ..... 347/19
See application file for complete search history.

(56) References Cited

U.S. PATENT DOCUMENTS 4,999,646 A 3/1991 Trask
5,099,256 A * 3/1992 Anderson ..... 347/103
5,170,177 A 12/1992 Stanley et al.
5,353,387 A 10/1994 Petschik et al.
5,422,664 A 6/1995 Stephany
5,600,352 A 2/1997 Knierim et al.
5,625,390 A 4/1997 Burke et al.
5,661,507 A 8/1997 Sperry
6,099,108 A 8/2000 Weber et al.
6,116,717 A 9/2000 Anderson et al.
6,305,773 B1 10/2001 Burr et al.
6,312,078 B1 11/2001 Wen
6,604,806 B1 8/2003 Yamada et al.
6,764,156 B2 7/2004 Mantell
6,819,352 B2 11/2004 Mizes et al.
6,830,306 B2 12/2004 Couwenhoven et al.
7,008,036 B2 3/2006 Ju et al.
7,095,531 B2 8/2006 Mizes et al.
2006/0066646 A1 * 3/2006 Yamanobe ..... 347/5

* cited by examiner

*Primary Examiner*—Julian D Huffman
(74) *Attorney, Agent, or Firm*—Maginot, Moore & Beck

(57) ABSTRACT

A method enables an ink jet imaging device to normalize the driving signals for the ink jets within a print head of the device. The method includes generating an ink jet driving signal at an initial voltage and a particular resolution, coupling the ink jet driving signal to an ink jet for selective emission of ink from the ink jet in accordance with the driving signal, and detecting whether continuity for a line formed on the ink receiver by the emission of ink from the ink jet is substantially continuous.

6 Claims, 7 Drawing Sheets

SYSTEM AND METHOD FOR EVALUATING LINE FORMATION IN AN INK JET IMAGING DEVICE TO NORMALIZE PRINT HEAD DRIVING VOLTAGES

TECHNICAL FIELD

This disclosure relates generally to imaging devices that eject ink from ink jets onto print drums to form images for transfer to media sheets and, more particularly, to imaging devices that use phase change inks.

BACKGROUND

An ink jet printer produces images on a receiver by ejecting ink droplets onto the receiver in a raster scanning fashion. The advantages of non-impact, low noise, low energy use, and low cost operation are largely responsible for the wide acceptance of ink jet printers in the marketplace.

Ink jet printers, however, may produce undesirable image defects in a printed image. One such image defect is non-uniform print density, such as "banding" and "streaking." One major cause of "banding" and "streaking" is variation in the mass of the ink droplets ejected from different ink nozzles. These variations in ink mass may be caused by variations in the nozzles of a print head. The differences in the nozzles of a print head may be caused by deviations in the physical characteristics (e.g., the nozzle diameter, the channel width or length, etc.) or the electrical characteristics (e.g., thermal or mechanical activation power, etc.) of the nozzles. These variations are often introduced during print head manufacture and assembly.

The nozzles of a print head are typically arranged in arrays having row and columns. Therefore, banding and/or streaking effects may occur in a horizontal or vertical line of an image. The variations in the ink drops that cause these defects relate to the density, size, or morphology of the ink dots that form an image. These variations can have a static (i.e., consistent) component and a random (i.e., non-consistent) component. Random variations between ink dots are generally less visible because their effects tend to cancel-out each other. The static variations are usually repeated more consistently and, thus, are more likely to be visible as banding or streaking defects.

There are many techniques present in the prior art that describe methods of reducing banding artifacts caused by nozzle-to-nozzle differences using methods referred to as "interlacing," "print masking," or "multi-pass printing." These techniques employ methods of advancing a media sheet or image drum by an increment less than the print head width, so that successive passes or swaths of the print head overlap. This type of control has the effect that neighboring image raster lines are printed using more than one nozzle. Therefore drop volume or drop trajectory errors observed in a given printed raster line are reduced because the nozzle-to-nozzle differences are averaged out as the neighboring nozzle mixing is increased. Other methods known in the art take advantage of multi-pass printing to reduce banding by using operative nozzles to compensate for failed or malfunctioning nozzles. For example, U.S. Pat. Nos. 6,354,689 and 6,273,542 to Couwenhoven et al., teach methods of correcting malfunctioning nozzles that have trajectory or drop volume errors in a multi-pass inkjet printer wherein other nozzles that print along substantially the same raster line as the malfunctioning nozzle are used instead of the malfunctioning nozzle. However, the above mentioned methods provide for reduced banding artifacts at the cost of increased print time, since the effective number of nozzles in the print head is reduced by a factor equal to the number of print passes.

Other techniques known in the art attempt to correct for drop volume variation by modifying the electrical signals that are used to activate the individual nozzles. For example, U.S. Pat. No. 6,428,134 to Clark et al. teaches a method of constructing waveforms for driving a piezoelectric inkjet print head to reduce ink drop volume variability. Similarly, U.S. Pat. No. 6,312,078 to Wen et al. teaches a method of reducing ink drop volume variability by modifying the drive voltage used to activate the nozzle.

Still other techniques known in the prior art address drop volume variation issues between print heads. For example, U.S. Pat. No. 6,154,227 to Lund teaches a method of adjusting the number of micro-drops printed in response to a drop volume parameter stored in programmable memory on the print head cartridge. This method reduces print density variation from print head to print head, but does not address print density variation from nozzle to nozzle within a print head. Also, U.S. Pat. Nos. 6,450,608 and 6,315,383 to Sarmast et al., teach methods of detecting inkjet nozzle trajectory errors and drop volume using a two-dimensional array of individual detectors.

One issue arising from variations in nozzle manufacture is the appearance of banding in the y-axis of an image. The y-axis of an image corresponds to the vertical dimension of an image. In an ink imaging device that ejects ink onto a media sheet, a banding defect may be seen in a line extending down the length of the page. In an ink imaging device that ejects ink onto a rotating image drum, a y-axis defect occurs in the direction of drum rotation. In some of the remedial techniques noted above, the driving signal to the nozzles of a print head are adjusted in response to measurements taken from a media sheet onto which a test image has been printed. These measurements typically include optical density measurements. Because an ink drop with a larger ink mass effectively absorbs more light than an ink drop having a smaller ink mass, measurements of the optical densities on a media sheet indicate which nozzles generate ink drops having large ink masses and those nozzles that generate ink drops having smaller ink masses. The voltage level of the driving signal may then be adjusted to reduce the mass of ink ejected by a nozzle producing too much ink or to increase the mass of ink ejected by a nozzle producing too little ink.

While these techniques may be useful in ink imaging devices that eject ink directly onto a media sheet or in an inkjet offset process, they may not be optimal or sufficient in ink imaging devices that scan the ink directly on the imaging surface. For example, in an offset process, the ink is ejected onto an intermediate drum prior to being transferred to paper. If done correctly, the above-described techniques enable field calibrations to be performed automatically by the printer to provide a better customer solution. Measuring jet-to-jet drop mass of ink on an intermediate transfer surface with an ink optical density sensor, however, is a challenging problem. Calibration time, cost, physical space constraints weigh against the use of a very sophisticated sensor. Also, most practical scanning systems have inherent sensor to sensor differences that add noise to the measurements. Other problems arise from the loss of information obtained from observing a printed test pattern on an intermediate transfer surface. For example, in an offset transfix process, such as the one described above, the ink spreads significantly during image transfer from the drum to the media. This spreading is achieved through a mechanical pressure process in which the nip between the transfer roller and the imaging drum presses the ink into the media sheet. Thus, larger drops spread out more than smaller drops with a resulting difference in intensity on the media. These intensity differences may be easily scanned and corrected. Another problem with jet-to-jet drop mass measurement on an intermediate transfer surface is the difference in contrast between the imaging drum and the ejected ink compared to the contrast achieved between ink and paper. Because the imaging drum is typically not as white and, therefore, not as reflective as a sheet of paper, for example, the optical density measurements of ink on an imaging drum are attenuated. Consequently, ink mass differences are more difficult to perceive from images on a rotating imaging drum. Therefore, methods of jet-to-jet calibration that increase or maximize the signal to noise ratio of the jet-to-jet drop mass are desirable.

SUMMARY

A method enables an ink jet imaging device to normalize the driving signals for the ink jets within a print head of the device. The method includes generating an ink jet driving signal at an initial voltage and a particular resolution, coupling the ink jet driving signal to an ink jet for selective emission of ink from the ink jet in accordance with the driving signal, and detecting whether a line formed on an ink receiver by the emission of ink from the ink jet is substantially continuous. The method may vary either the voltage of the driving signal while holding the resolution of the signal steady or vice versa. When a substantially continuous line is detected, the method has determined the voltage that generates an ink drop having an adequate mass for forming a continuous line at the particular resolution or has determined the resolution at which the voltage generates a substantially continuous line.

An ink jet imaging device may be constructed to implement the method for normalizing the driving signals to ink jets in a print head. The imaging device includes a motor for moving an ink receiver, an imaging device controller for coupling a speed signal to the motor so the ink receiver moves at a speed corresponding to a particular resolution, a print head having a plurality of ink jets, a print head controller for generating a plurality of ink jet driving signals having an initial voltage and a particular resolution and for coupling each ink jet driving signal to an ink jet for selective emission of ink from the ink jet in accordance with the driving signal, and a scanner for scanning the ink receiver and detecting discontinuities in a line formed on the image drum by the emission of ink from the ink jet.

BRIEF DESCRIPTION OF THE DRAWINGS

The foregoing aspects and other features of a printer implementing a power conservation process are explained in the following description, taken in connection with the accompanying drawings, wherein.

DETAILED DESCRIPTION

Figure 1:
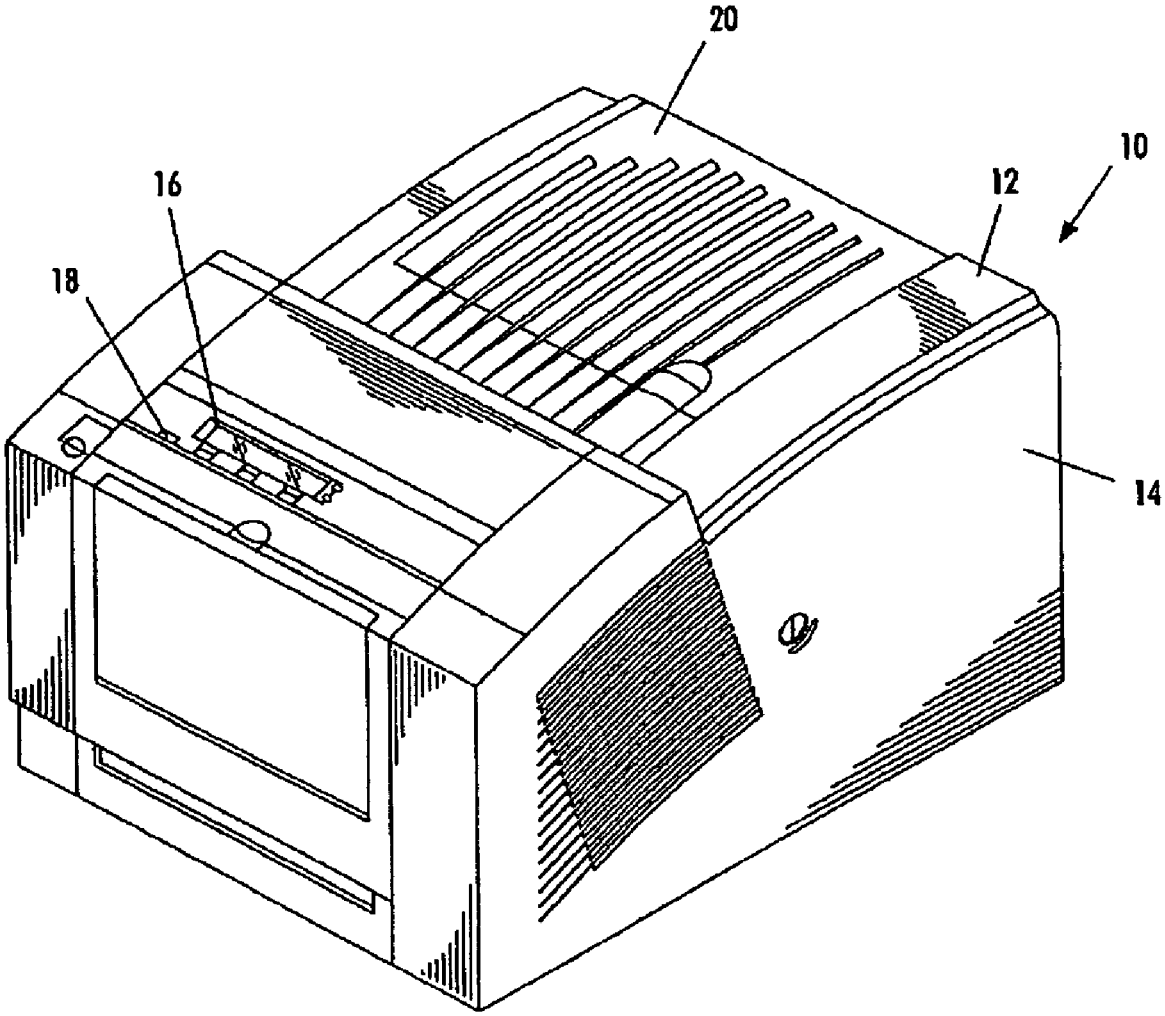
FIG. 1 is a perspective view of a solid ink printer that can normalize the driving signals for the ink jets in its print head.

Referring to FIG. 1, there is shown a perspective view of an ink printer 10 that implements a solid ink offset print process. The reader should understand that the embodiment discussed herein may be implemented in many alternate forms and variations and is not limited to solid ink printers only. For example, the process and system are described below with reference to an image drum or other rotating intermediate member, such as a rotating belt. The system and method may be used to adjust the emission of ink on other types of ink receivers onto which ink is directly emitted, such as media sheets. In addition, any suitable size, shape or type of elements or materials may be used.

FIG. 1 shows a solid ink printer 10 that includes an outer housing having a top surface 12 and side surfaces 14. A user interface display, such as a front panel display screen 16, displays information concerning the status of the printer, and user instructions. Buttons 18 or other control actuators may be used to select or define parameters for controlling operation of the printer. The buttons may be located adjacent the user interface display 16 or they may be provided at other locations on the printer. Additionally or alternatively, buttons 18 may be implemented as radio buttons on the display 16. In such an embodiment, the user display 16 also incorporates a touch screen to provide input data to the printer controller.

An ink feed system delivers ink to an ink jet printing mechanism (not shown) that is contained inside the housing. The ink feed system may be accessed through the hinged ink access cover 20 that opens to reveal keyed openings and feed channels having an ink load linkage. The ink access cover and the ink load linkage may operate as described in U.S. Pat. No. 5,861,903 for an Ink Feed System, issued Jan. 19, 1999 to Crawford et al. In one embodiment, the ink jet printing mechanism ejects ink onto a rotating intermediate imaging member and the image is transferred to a sheet of media. In another embodiment, the ink jet printing mechanism ejects the ink directly onto a media sheet.

Figure 2:
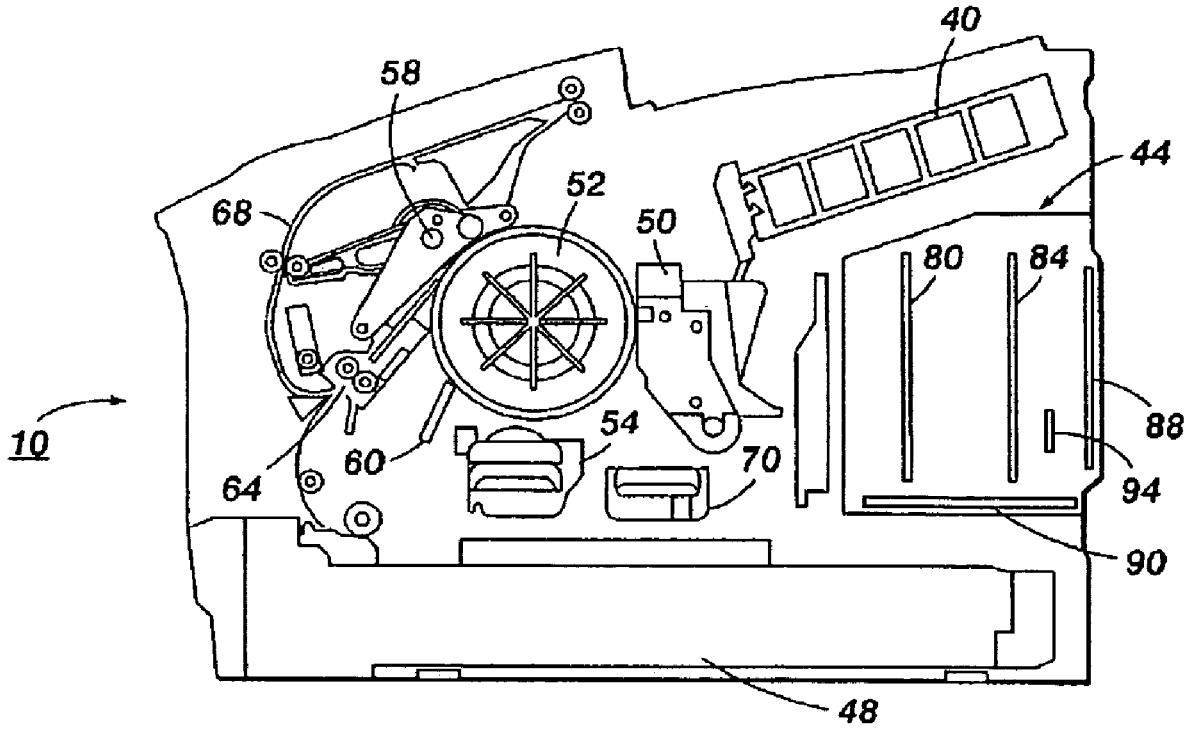
FIG. 2 is a side view of the printer shown in FIG. 1 that depicts the major subsystems of the solid ink printer.

As shown in FIG. 2, one embodiment of the ink printer 10 may include an ink loading subsystem 40, an electronics module 44, a paper/media tray 48, a print head 50, an intermediate imaging member 52, a drum maintenance subsystem 54, a transfer subsystem 58, a wiper subassembly 60, a paper/media preheater 64, a duplex print path 68, and an ink waste tray 70. In brief, solid ink sticks are loaded into ink loader 40 through which they travel to a melt plate located at the end of loader 40. At the melt plate, the ink stick is melted and the liquid ink is diverted to a reservoir in the print head 50. The ink is ejected by piezoelectric elements through apertures in plates to form an image on a liquid layer that is supported by the intermediate imaging member 52 as the member rotates. An intermediate imaging member heater is controlled by a controller to maintain the imaging member within an optimal temperature range for generating an ink image and transferring it to a sheet of recording media. A sheet of recording media is removed from the paper/media tray 48 and directed into the paper pre-heater 64 so the sheet of recording media is heated to a more optimal temperature for receiving the ink image. A synchronizer delivers the sheet of the recording media so its movement between the transfer roller in the transfer subsystem 58 and the intermediate image member 52 is coordinated for the transfer of the image from the imaging member to the sheet of recording media.

The operations of the ink printer 10 are controlled by the electronics module 44. The electronics module 44 includes a power supply 80, a main board 84 with a controller, memory, and interface components (not shown), a hard drive 88, a power control board 90, and a configuration card 94. The power supply 80 generates various power levels for the various components and subsystems of the printer 10. The power control board 90 includes a controller and supporting memory and I/O circuits to regulate these power levels. The configuration card contains data in nonvolatile memory that defines the various operating parameters and configurations for the components and subsystems of the printer 10. The hard drive stores data used for operating the ink printer and software modules that may be loaded and executed in the memory on the main board 84. The main board 84 includes the controller that operates the printer 10 in accordance with the operating program executing in the memory of the main board 84. The controller receives signals from the various components and subsystems of the printer 10 through interface components on the main board 84. The controller also generates control signals that are delivered to the components and subsystems through the interface components. These control signals, for example, drive the piezoelectric elements to expel ink through print head apertures to form the image on the imaging member 52 as the member rotates past the print head.

Figure 3A:
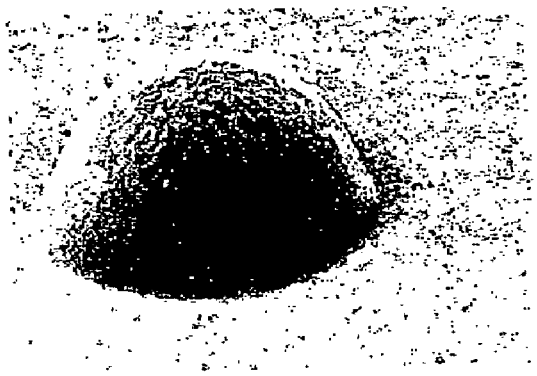
FIGS. 3A, 3B, and 3C depict an isolated ink drop, a partially coalesced line, and a fully coalesced line, respectively.
Figure 3B:
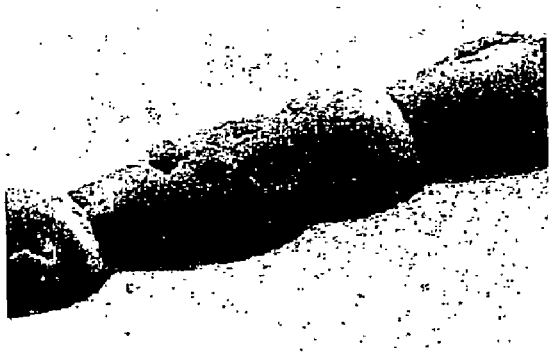
Figure 3C:
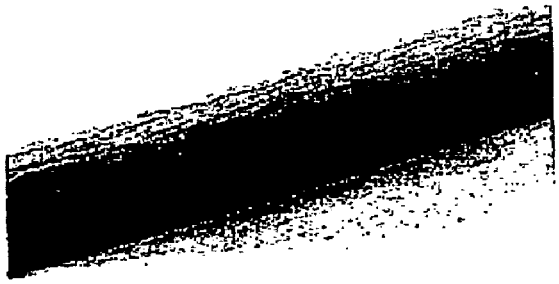

When the nozzles arranged in a column of the print head 50 are activated by a driving signal, they eject ink onto the imaging drum 52. The imaging drum 52 typically has a surface of anodized aluminum and is covered with a thin liquid layer, typically, of a release oil. The surface texture of the drum and the film of release oil cause free-surface phenomena, such as, wetting, coalescence, draw back, and also involve droplet solidification as the drum is maintained at a temperature that is lower than the melting point of the ink. These phenomena effect the generation of the image on the drum. One effect, coalescence, is related to ink drop mass. If an ink drop mass is ejected onto an imaging drum with too little mass or ejected onto a location separated from the adjacent pixels, an isolated drop is formed as shown in FIG. 3A. A plurality of ink drops having too little mass or being too remote from one another to fully interact, results in a partially coalesced line as shown in FIG. 3B. In FIG. 3B, adjacent ink drops have partially merged together to form an irregular line. Ink drops having an adequate mass as well as being correctly located to one another result in a fully coalesced line as shown in FIG. 3C. The line shown in FIG. 3C is a substantially continuous line in which adjacent ink drops have coalesced to present a uniform appearance.

Figure 4A:
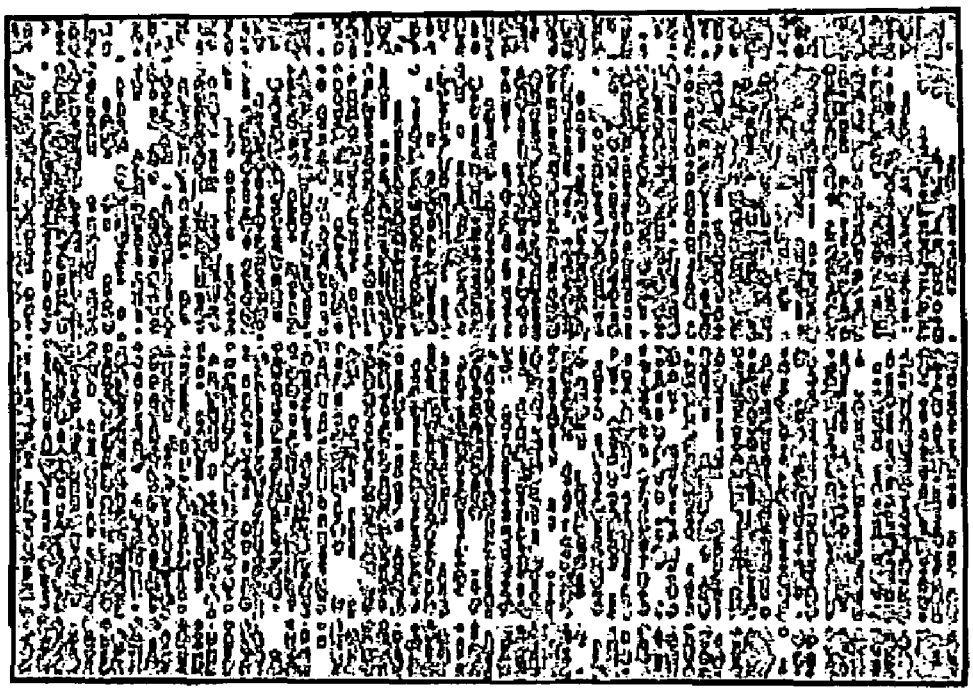
FIGS. 4A and 4B depict lines on an imaging drum in the Y direction with lines in FIG. 4A being irregular and those in FIG. 4B being substantially continuous.
Figure 4B:
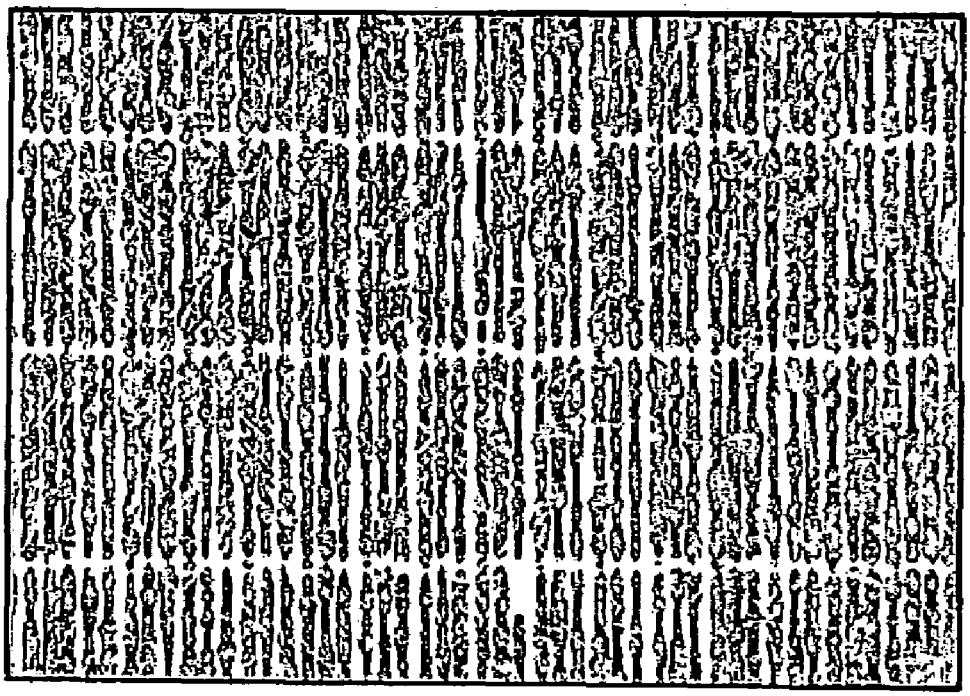

As shown in FIG. 4A, isolated drops and partially coalesced lines result in gaps or irregular lines. The relatively straight and continuous blank line between the irregularly formed blocks as shown in FIG. 4A are blank lines that arise from the termination of the activation pulse to a nozzle and the rotation of the drum in Y direction. When the signals to the nozzles and print head are adjusted as described below, the ink drop masses are altered so the ink drops fully coalesce and form lines in the Y direction as shown in FIG. 4B.

At a particular resolution, the ink jet nozzles are activated with a driving signal having an initial voltage that is correlated to a target ink drop mass. In other words, an activation signal having the initial voltage level should cause the ejection of an ink drop having a mass that will fully coalesce with adjacent ink drops to form a substantially continuous line on the imaging drum 52. Unfortunately, manufacturing differences may cause ink jet nozzle differences that adversely impact the mass of the ink drop ejected by one or more nozzles. In a process called normalization, the voltage levels for the driving signals to the nozzles that do not eject an appropriate mass of ink are incrementally increased until the ink drop ejected by a nozzle fully coalesces with the adjacent ink drops. Although, the discussion presented here and below is directed to incrementally increasing the voltage level to eject an ink drop having an appropriate ink mass for full coalescence, the normalization technique may be implemented by incrementally decreasing the voltage level of the driving signal. That is, an initial voltage may be selected that causes all of the nozzles to generate an ink drop having too large of a mass and then the driving signals are incrementally decreased until a line is formed having some irregularities in it. That line represents the transition from a fully coalesced line to a non-uniform line and the voltage associated with the fully coalesced line may be used.

Figure 5:
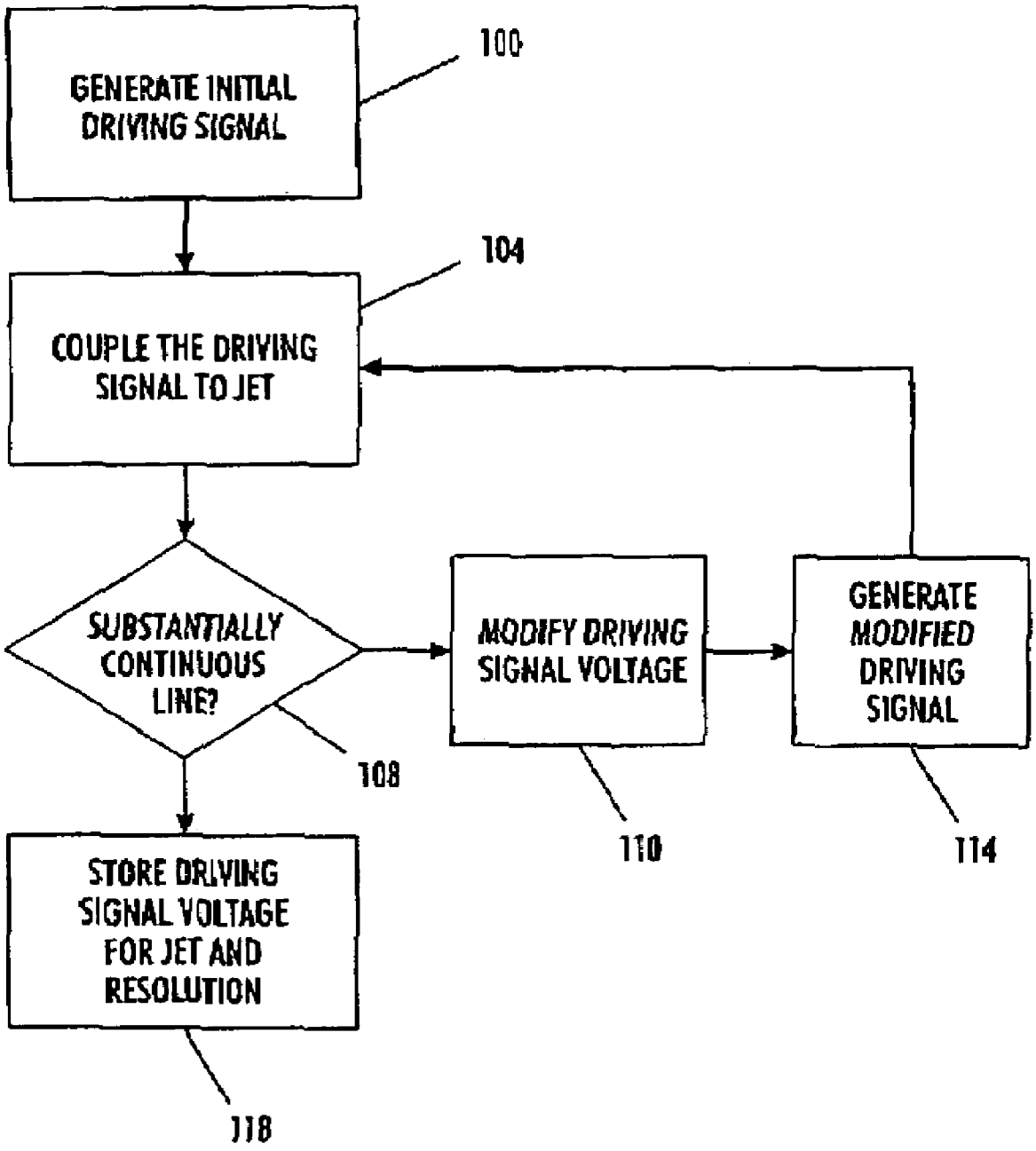
FIG. 5 is a flow diagram of method for normalizing the signals to the ink jets of the print head of the printer shown in FIG. 1.

An exemplary normalization method that may be used to adjust the driving signals for the nozzles in a print head is shown in FIG. 5. While an ink receiver, such as an image drum, is moving past a print head, an initial driving signal is generated (block 100). The driving signal may be a periodic signal that is sent to a nozzle. The positive portion of the driving signal causes the piezoelectric ejector in an ink jet nozzle to eject ink, and the zero portion of the driving signal wave form terminates the ejection of ink from the nozzle. The amplitude of the driving signal voltage determines the amount of mass in the ink drop ejected by the nozzle. Thus, the initial driving signal is set at a voltage that correlates to a target ink drop mass for a nozzle. The periodicity of the waveform for the driving signal corresponds to the resolution for an image.

The generated driving signal is coupled to its corresponding ink jet nozzle (block 104). The continuities of the lines in the Y direction are detected to determine that they are substantially continuous (block 108). In response to a portion of a line indicating isolated drops or a partially coalesced line, the driving signal voltage is modified (block 110). This modification may include incrementally increasing the voltage of the driving signal to cause the ink jet nozzle to eject an ink drop having a larger mass. A driving signal having the modified voltage is then generated (block 114) and the modified driving signal is coupled to the jet (block 104). This process continues until the line formed by all the nozzles in a vertical column of a print head array are detecting as forming a substantially continuous line. In response to the determination that a substantially continuous line is formed, the driving signal voltage for an ink jet is stored in association with the resolution corresponding to the periodicity of the driving signal (block 118). In following this process for each ink jet in a print head array, the actuation driving signal voltage for a particular resolution is determined. The driving signal voltage stored for an ink jet is the actual driving signal voltage required for the ink jet to eject the target mass for an ink drop instead of the voltage for which the nozzle was designed at the time of its manufacture. Thus, this process enables the driving signals to be adjusted for a particular resolution to compensate for the variations that may occur during the manufacture of a print head.

Figure 6:
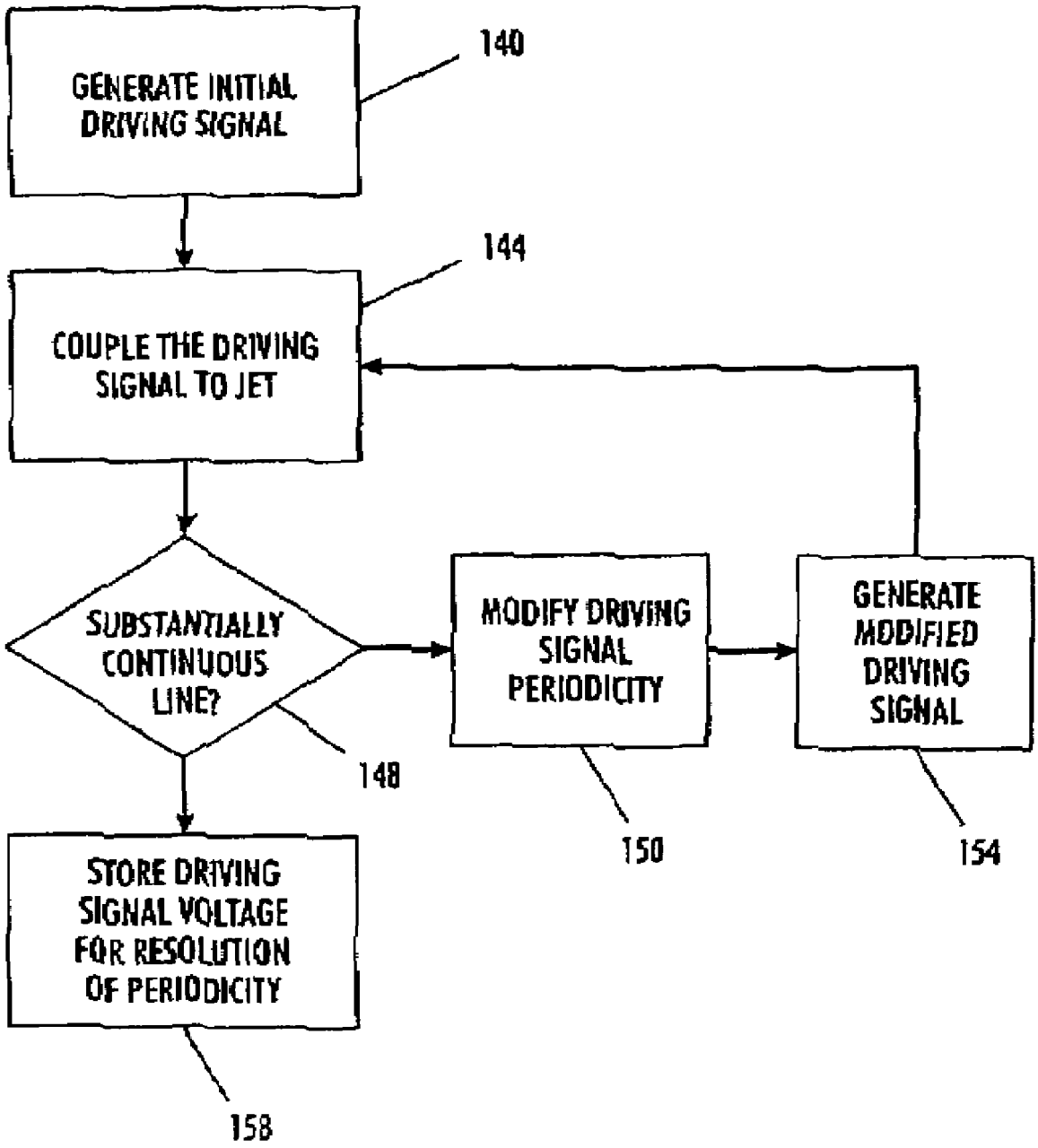
FIG. 6 is a flow diagram of an alternative method for normalizing the signals to the ink jets of the print head of the printer shown in FIG. 1.

An alternative method for normalizing the driving signals for the ink jets in a print head array is shown in FIG. 6. This process is similar to the one shown in FIG. 5 with the exception that the voltage of the waveform remains constant while the resolution for the driving signal is altered. The resolution may be altered by modifying the periodicity of the driving signal or the velocity difference between the print head and the ink receiver surface. In this manner, the distance between adjacent ink drops is reduced until the ink drops coalesce and form a substantially continuous line. In this process, an initial driving signal is generated (block 140). The driving signal is coupled to its corresponding jet (block 144) then the continuity of the resulting line is detected to determine whether it is substantially continuous (block 148). For those segments of a line that are not substantially continuous, the driving signal periodicity is modified (block 150). A modified driving signal is generated (block 154) and the new driving signal coupled to its corresponding jet (block 144). This loop continues until the resolution is reached at which most of the ink drops fully coalesce to form a substantially continuous line. The resolution for the driving signal is then stored in associating with the driving signal voltage for the ink jet.

The detection of the continuities for the lines formed on an ink receiver may be performed using a variety of techniques. For example, a scanner formed of light emitting diodes may be pulsed to direct light toward a raster line in a formed image. The pulse rate of the light emitting diodes corresponds to the Y axis separation of the ink jet nozzles. Each LED has a corresponding photo detector. Ink drops that have fully coalesced absorb most of the light emitted by the LED. Consequently, little light is reflected to the photo detector. Areas having isolated drops or partially coalesced line segments enable more light to be reflected into the photo detector. Consequently, the detection of light by the photo detector indicates an isolated drop or partially coalesced line segment. These may be designated as "voids." By counting voids, a continuity parameter may be measured for a line formed on the imaging drum. One such continuity parameter is the number of voids counted for a line divided by the number of ink jet nozzles in a column of a print head array. A threshold may be empirically determined for the value of this ratio that is indicative of a substantially continuous line. Other such continuity parameters may be used. The continuity parameter related to voids differs from the optical density parameter as it does not measure the density of the ink on the drum. Instead, it measures the degree of coalescence between ink drops. This difference enables the scanner and photo detector arrangement to be used to detect ink drop mass directly from a line formed on an imaging drum rather than detecting the line transferred to a media sheet. Other evaluation methods may include a statistical analysis of the voids in the line to detect that a line is substantially continuous in response to the statistical analysis indicating the line uniformity is within $2\sigma$ of uniformity for a line of a particular resolution.

Figure 7:
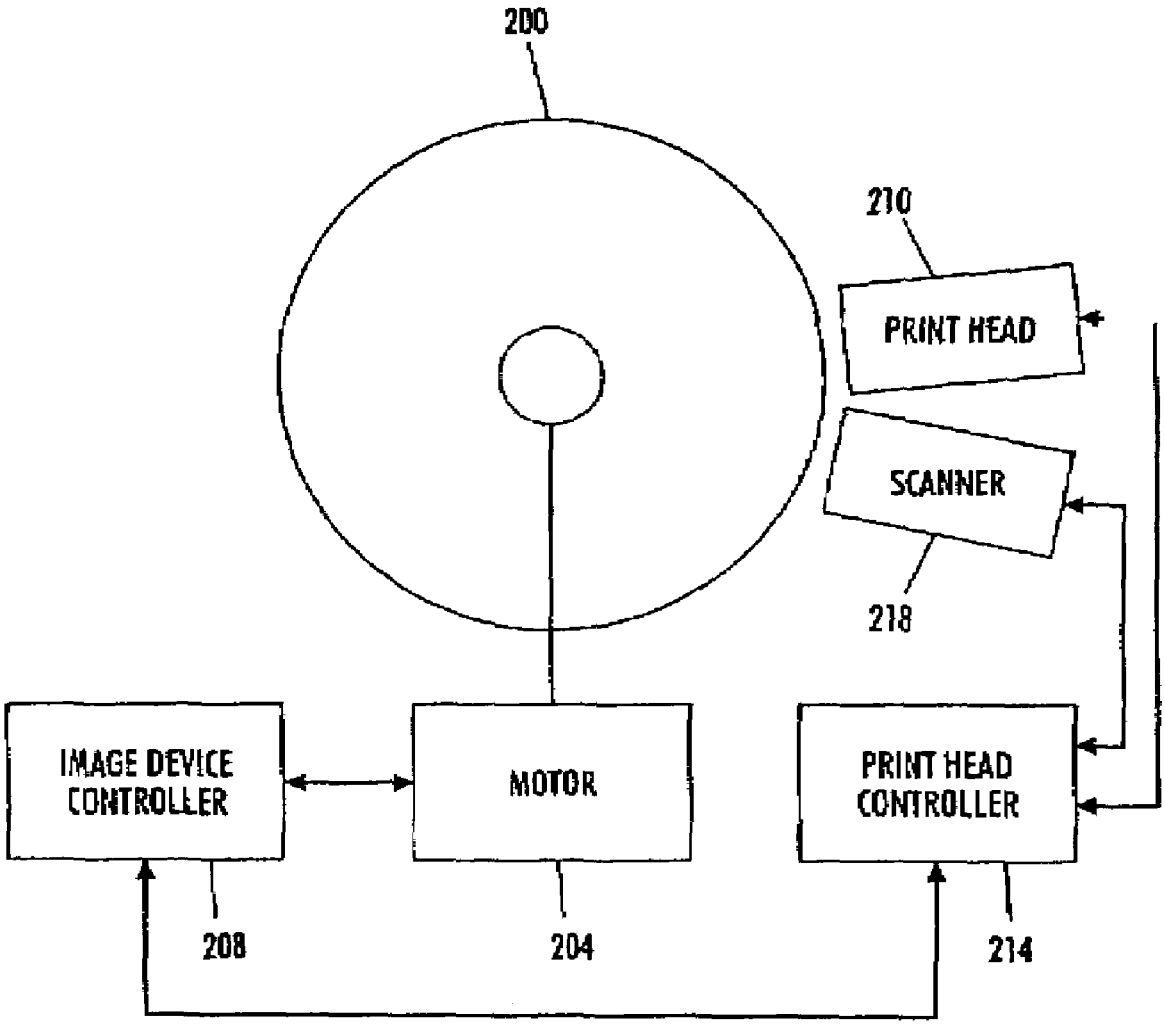
FIG. 7 is a block diagram of the components in the printer of FIG. 1 that may be used to implement the method shown in FIG. 5.

A block diagram of the components that may be used to implement a method for normalizing the driving signals to ink jet nozzles is shown in FIG. 7. The system may include an ink receiver, such as the imaging drum 200, a motor 204 for rotating the imaging drum, an imaging device controller 208, a print head having a plurality of ink jets 210, a print head controller 214, and a scanner 218. The imaging device controller generates and couples a speed signal to the motor to control the speed at which the ink receiver is moved past the print head. In the device shown in FIG. 7, the motor is controlled to manage the rotational speed of the imaging drum and is done in a known manner. The print head controller is the same print head controller that generates the driving signal for print head nozzles. The programmed instructions for this controller include program instructions for implementing a normalization process. Thus, the programmed instructions cause the print head controller to generate the initial driving signal and modify the driving signal until a substantially continuous line is detected. The print head controller 214 is coupled to the scanner 218 to receive a continuity signal from the scanner.

The scanner 218 includes a light generator and an array of photo detectors. As described above, the light generator may be a plurality of LEDs or other light emitting devices that illuminate a portion of the imaging drum. The photo detectors detect the presence or absence of ink so a continuity parameter may be measured to determine whether the line formed is substantially continuous. The scanner 218 may include a signal summer that indicates the number of voids in a line segment and this measurement may be compared to a threshold indicative of whether the line is fully coalesced.

In operation, the components of a solid ink printer are modified to include a scanner and the programmed instructions to implement the normalization method. As part of a setup or maintenance routine, the print head controller is enabled to perform the normalization process. In response to this actuation, the print head controller generates a driving signal having either a constant resolution periodicity or a constant voltage. The driving signal voltage or periodicity of the signal, respectively, is then varied and a continuity parameter for the line formed on an imaging drum is evaluated. Once the system and process determines that the line formed on the imaging drum is substantially continuous, the voltage or periodicity is recorded for the particular resolution so that the determined voltage or periodicity may be used to subsequently drive the ink jet nozzles at the desired level.

Those skilled in the art will recognize that numerous modifications can be made to the specific implementations described above. For example, those skilled in the art will recognize that while exemplary techniques for evaluating line continuity have been discussed that other techniques may be used as well. Also, while the embodiments above have been described with reference to a solid ink offset printer, the normalization method set out above may be used with any ink jet imaging device, including those that directly print ink receivers. In these devices, for example, the scanner is located at a position past the print head to detect continuity of lines printed on the sheet as it moves through the device. Adjustments may be made for printing on another section of the same sheet or on following sheets and the continuities of these lines detected. The process may continue until the lines are detected as being substantially continuous. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

I claim:

1. An ink jet imaging device comprising:

a motor configured to move an ink receiver;

an imaging device controller configured to generate and to couple a speed signal to the motor to move the ink receiver at a speed corresponding to a particular resolution;

a print head having a plurality of ink jets;

a print head controller configured to generate a plurality of ink jet driving signals having an initial voltage and a particular resolution and to couple each ink jet driving signal to an ink jet to eject ink selectively from the ink jet in accordance with the driving signal received by the ink jet;

a scanner having a signal summer and being configured to scan the ink receiver and to generate a line discontinuity signal indicative of a number of discontinuities detected in a line formed on the ink receiver by the ink ejected from at least one ink jet; and a driving signal adjuster configured to adjust one of a voltage and a resolution for an ink jet driving signal in response to the line discontinuity signal received from the scanner.

2. The system of claim 1, the ink receiver being an image drum and the motor rotates the image drum at a rotational speed corresponding to the particular resolution.

3. The system of claim 1, the ink receiver being a media sheet and the motor drives a sheet feed at a speed that moves the media sheet past the print head at a speed corresponding to the particular resolution.

4. The system of claim 2, the scanner further comprising:

a light generator for illuminating a portion of the image drum as it rotates; and an array of photodetectors for detecting the presence of ink in response to the illumination of the image drum by the light generator.

5. The imaging device of claim 1 wherein the driving signal adjuster adjusts periodicity of the driving signal to adjust the resolution of the driving signal in response to the line discontinuity signal received from the scanner.

6. The imaging device of claim 1 wherein the scanner is configured to generate a continuity parameter corresponding to a number of detected line discontinuities and a number of ink jets.

* * * * *